US008424311B2

(12) United States Patent
York et al.

(10) Patent No.: US 8,424,311 B2
(45) Date of Patent: Apr. 23, 2013

(54) PREMIXED DIRECT INJECTION DISK

(75) Inventors: William David York, Greer, SC (US); Willy Steve Ziminsky, Simpsonville, SC (US); Thomas Edward Johnson, Greer, SC (US); Benjamin Lacy, Greer, SC (US); Baifang Zuo, Simpsonville, SC (US); Jong Ho Uhm, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 740 days.

(21) Appl. No.: 12/394,544

(22) Filed: Feb. 27, 2009

(65) Prior Publication Data

US 2010/0218501 A1 Sep. 2, 2010

(51) Int. Cl.
*F23R 3/286* (2006.01)

(52) U.S. Cl.
USPC ..... 60/737

(58) Field of Classification Search ..... 60/737, 60/740, 742, 39.463, 39.37, 752–760
See application file for complete search history.

(56) References Cited

U.S. PATENT DOCUMENTS 4,047,877 A * 9/1977 Flanagan ..... 431/8
4,100,733 A * 7/1978 Striebel et al. ..... 60/39.463
4,845,952 A * 7/1989 Beebe ..... 60/737
5,235,814 A * 8/1993 Leonard ..... 60/738
6,301,899 B1 * 10/2001 Dean et al. ..... 60/737
6,442,939 B1 * 9/2002 Stuttaford et al. ..... 60/737
7,003,958 B2 * 2/2006 Dinu et al. ..... 60/737
7,007,478 B2 * 3/2006 Dinu ..... 60/737
7,093,438 B2 * 8/2006 Dinu et al. ..... 60/737
7,107,772 B2 * 9/2006 Chen et al. ..... 60/737
7,237,384 B2 * 7/2007 Stuttaford et al. ..... 60/776
7,509,808 B2 * 3/2009 Storey et al. ..... 60/740
8,322,143 B2 * 12/2012 Uhm et al. ..... 60/737
2003/0010032 A1 * 1/2003 Stuttaford et al. ..... 60/737
2005/0050895 A1 * 3/2005 Dorr et al. ..... 60/737
2010/0186413 A1 * 7/2010 Lacy et al. ..... 60/740
2010/0192581 A1 * 8/2010 Ziminsky et al. ..... 60/737

* cited by examiner

*Primary Examiner* — Phutthiwat Wongwian
*Assistant Examiner* — Carlos A Rivera
(74) *Attorney, Agent, or Firm* — Cooper Legal Group, LLC

(57) ABSTRACT

A fuel/air mixing disk for use in a fuel/air mixing combustor assembly is provided. The disk includes a first face, a second face, and at least one fuel plenum disposed therebetween. A plurality of fuel/air mixing tubes extend through the premixing disk, each mixing tube including an outer tube wall extending axially along a tube axis and in fluid communication with the at least one fuel plenum. At least a portion of the plurality of fuel/air mixing tubes further includes at least one fuel injection hole have a fuel injection hole diameter extending through said outer tube wall, the fuel injection hole having an injection angle relative to the tube axis. The invention provides good fuel air mixing with low combustion generated NOx and low flow pressure loss translating to a high gas turbine efficiency, that is durable, and resistant to flame holding and flash back.

20 Claims, 6 Drawing Sheets

PREMIXED DIRECT INJECTION DISK

FEDERAL RESEARCH STATEMENT

This invention was made with Government support under Contract No. DE-FC26-05NT42643, awarded by the Department of Energy. The Government has certain rights in the invention.

BACKGROUND OF THE INVENTION

The subject matter disclosed herein relates to premixed direct injection combustion system and more particularly to a direct injection disk having good mixing, flame holding and flash back resistance.

The primary air polluting emissions usually produced by gas turbines burning conventional hydrocarbon fuels are oxides of nitrogen, carbon monoxide, and unburned hydrocarbons. It is well known in the art that oxidation of molecular nitrogen in air breathing engines is highly dependent upon the maximum hot gas temperature in the combustion system reaction zone. One method of controlling the temperature of the reaction zone of a heat engine combustor below the level at which thermal NOx is formed is to premix fuel and air to a lean mixture prior to combustion.

There are several problems associated with dry low emissions combustors operating with lean premixing of fuel and air. That is, flammable mixtures of fuel and air exist within the premixing section of the combustor, which is external to the reaction zone of the combustor. Typically, there is some bulk premixing zone velocity, above which a flame in the premixer will be pushed out to a primary burning zone. However, certain fuels such as hydrogen or syngas have a high flame speed. Due to the high turbulent flame velocity and wide flammability range, premixed hydrogen fuel combustion system design is challenged by flame holding and flashback at reasonable nozzle pressure loss. Diffusion combustion with hydrogen and syngas fuel using direct fuel injection methods inherently generates higher NOx than lean premixed combustion.

With natural gas as the fuel, premixers with adequate flame holding margin, that is an aerodynamic window to operate without flame holding inside the premixer, may usually be designed with reasonably low air-side pressure drop. However, with more reactive fuels, such as high hydrogen fuel, designing for flame holding margin and target pressure drop becomes a challenge. Since the design point of state-of-the-art nozzles may approach 3000 degrees Fahrenheit bulk flame temperature, flashback into the nozzle leading to a held flame could cause extensive damage to the nozzle in a very short period of time.

BRIEF DESCRIPTION OF THE INVENTION

The present invention is a premixed direct injection disk design that provides good fuel air mixing with low combustion generated NOx and low flow pressure loss translating to a high gas turbine efficiency. The premixed direct injection disk is designed to replace fuel nozzles and cap assembly that are commonly found at the held end of a can-style combustor. The invention is durable, easy to construct, and has low risk of flash back of the flame into the nozzle.

According to one aspect of the invention, a fuel/air mixing disk for use in a fuel/air mixing combustor assembly is provided. The disk includes a first face, a second face, and at least one fuel plenum disposed therebetween and adapted to be in fluid communication with a fuel flow passage. A plurality of fuel/air mixing tubes extend through the pre-mixing disk between a first face and a second face, each mixing tube including an outer tube wall extending axially along a tube axis between an inlet end and an exit end and in fluid communication with the at least one fuel plenum. At least a portion of the plurality of fuel/air mixing tubes further include at least one fuel injection hole having a fuel injection hole diameter extending through said outer tube wall. The at least one fuel injection hole has an injection angle relative to said tube axis, said injection angle being in the range of 20 to 90 degrees. A recession distance extends between said fuel injection hole and said exit end along said tube axis, said recession distance being about 5 to 100 times greater than said fuel injection hole diameter.

According to another aspect of the invention, a fuel/air mixing disk for use in a fuel/air premixing combustor assembly is provided. The disk includes a first face, a second face, and at least one fuel plenum disposed therebetween and adapted to be in fluid communication with a fuel flow passage. A plurality of fuel/air mixing tubes extends through the pre-mixing disk between a first face and a second face, each mixing tube including an outer tube wall extending axially along a tube axis between an inlet end and an exit end and in fluid communication with the at least one fuel plenum, and an inner tube surface having a inner diameter. Each of the plurality of fuel/air mixing tubes further includes at least one fuel injection hole having a fuel injection hole diameter extending through said outer tube wall. The at least one fuel injection hole has an injection angle relative to said tube axis, said inner diameter of said inner tube surface being from 2 to 20 times greater than said fuel injection hole diameter. A recession distance extends between said fuel injection hole and said exit end along said tube axis, said recession distance being about 1 to 50 times greater than said fuel injection hole diameter.

According to yet another aspect of the invention, a method of mixing high-hydrogen or synthetic gas fuel in a premixed direct injection disk for a turbine combustor is provided. The method comprises providing a disk having a first face, a second face, and at least one fuel plenum disposed therebetween and adapted to be in fluid communication with a fuel flow passage. The method further comprises providing fuel/air mixing tubes extending through the pre-mixing disk between a first face and a second face, each of said plurality of mixing tubes extending axially along a flow path between an inlet end and an exit end and in fluid communication with the at least one fuel plenum, each of said plurality of tubes including an outer tube wall extending axially along a tube axis between said inlet end and said exit end. The method further comprises injecting a first fluid into said plurality of mixing tubes at said inlet end, providing a high-hydrogen fuel or synthetic gas into said at least one fuel plenum, injecting the high-hydrogen fuel or synthetic gas from the at least one fuel plenum into said mixing tubes through a plurality of injection holes at angle in the range of 20 and 90 degrees relative to said tube axis, and mixing said first fluid and said high hydrogen fuel or synthetic gas to a mixedness of greater than 50% fuel and first fluid mixture at said exit end of said tubes.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
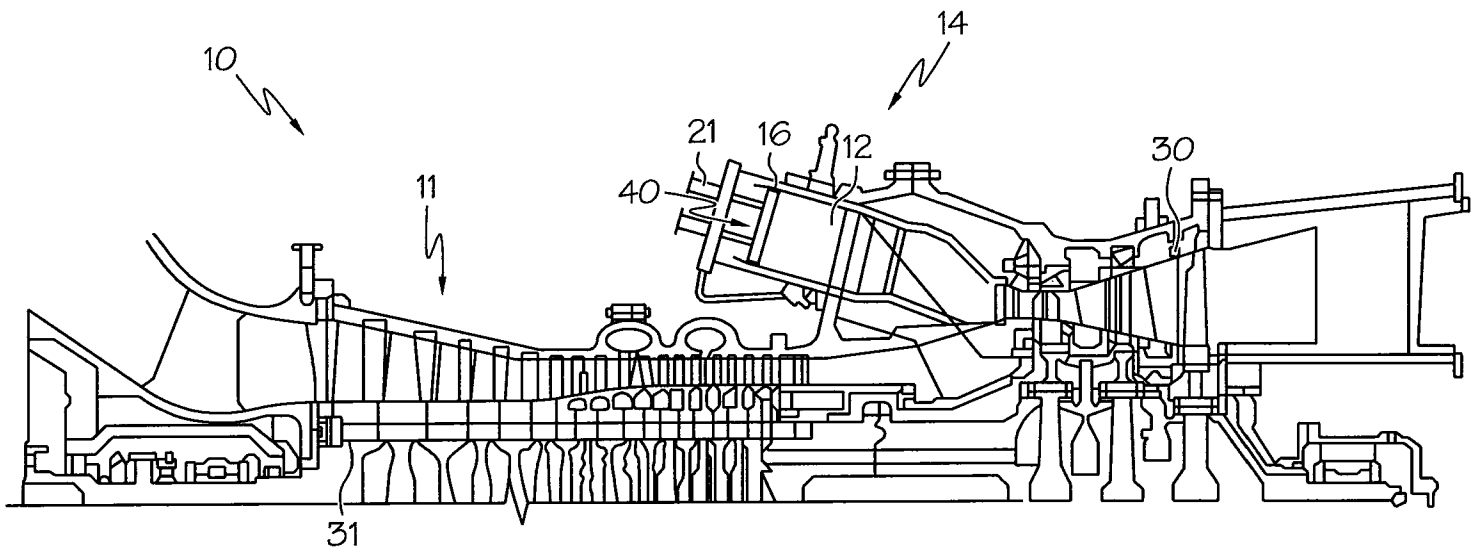
FIG. 1 is a cross-section of a gas turbine engine, including the location of the injection disk in accordance with the present invention.

Referring now to FIG. 1 where the invention will be described with reference to specific embodiments, without limiting same, a schematic illustration of an exemplary gas turbine engine 10 is shown. Engine 10 includes a compressor 11 and a combustor assembly 14. Combustor assembly 14 includes a combustor assembly wall 16 that at least partially defines a combustion chamber 12. A pre-mixing injection disk 40 extends across at least a portion of the combustor assembly 14 and leads into combustion chamber 12. As will be discussed more fully below, disk 40 receives a first fluid or fuel through a fuel inlet 21 and a second fluid or compressed air from compressor 11. The fuel and compressed air are then mixed, passed into combustion chamber 12 and ignited to form a high temperature, high pressure combustion product or gas stream. Although only a single combustor assembly 14 is shown in the exemplary embodiment, engine 10 may include a plurality of combustor assemblies 14. In any event, engine 10 also includes a turbine 30 and a rotor shaft 31. In a manner known in the art, turbine 30 is coupled to, and drives shaft 31 that, in turn, drives compressor 11. Shaft 31 may also be connected to and drive an electrical generator (not shown) or another rotating machine (not shown).

In operation, air flows into compressor 11 and is compressed to a high pressure, such as to a pressure within the range of about 10 atmospheres (atms) to about 25 atms, though other pressures are also contemplated. The high pressure gas is supplied to combustor assembly 14 and mixed with fuel, for example process gas and/or synthetic gas (syngas), such as high-hydrogen fuels, in pre-mixing disk 40. The fuel/air or combustible mixture is passed into combustion chamber 12 and ignited to form a high pressure, high temperature combustion gas stream. Alternatively, combustor assembly 14 can combust fuels that include, but are not limited to natural gas and other hydrocarbon fuels. Thereafter, combustor assembly 14 channels the combustion gas stream to turbine 30 which converts thermal energy to mechanical, rotational energy.

Figure 2:
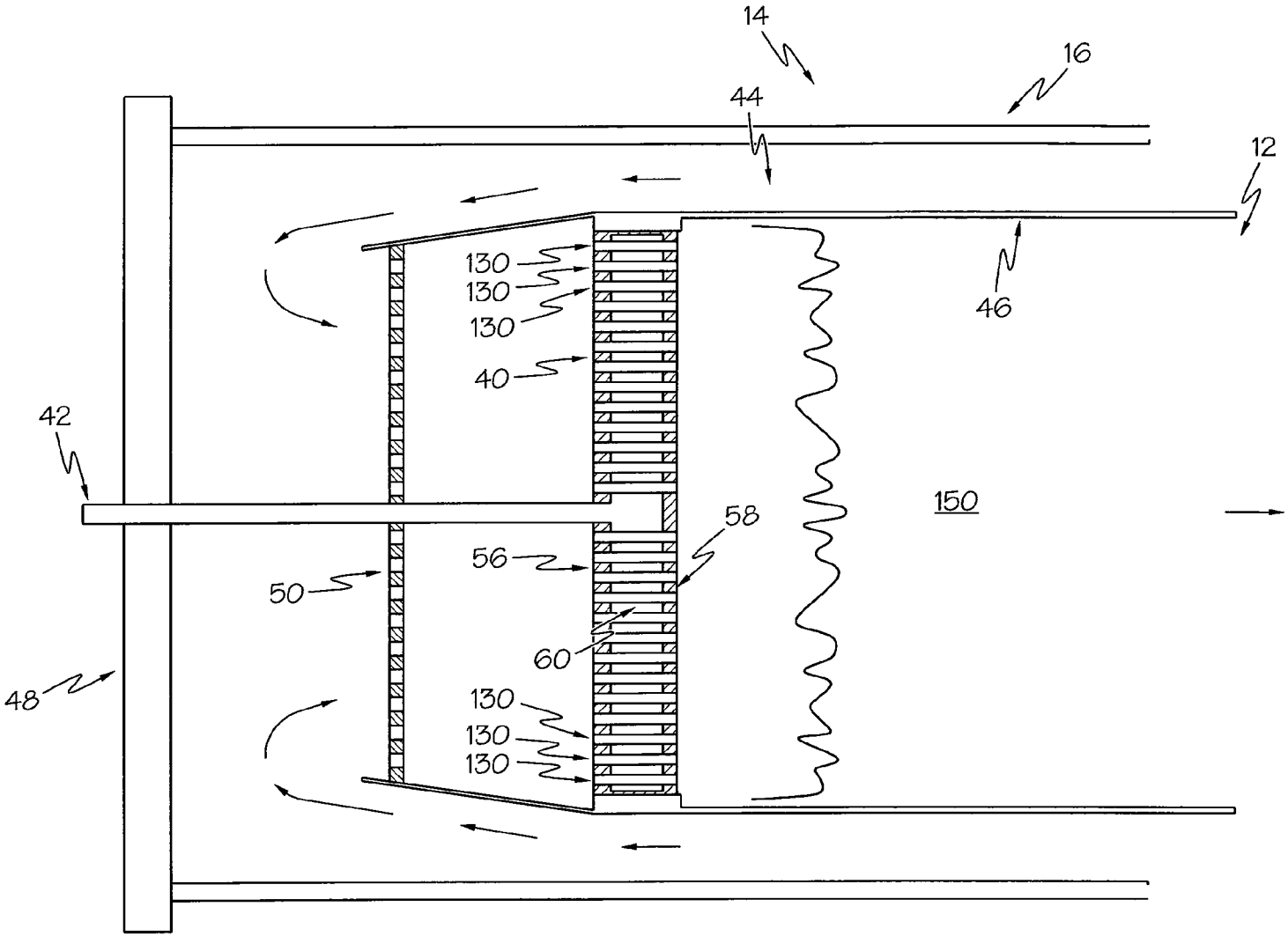
FIG. 2 is a cross-section of an example combustor assembly including an example pre-mixing injection disk in accordance with the present invention.

Referring now to FIG. 2, a cross-section through the combustor assembly 14 including an example pre-mixing disk 40 is shown. Pre-mixing disk 40 is connected to at least one fuel flow passage 42 (i.e., fuel supply line) and an annular channel 44 to receive a supply of air from compressor 11. As shown, the pre-mixing disk 40 is disposed between the annular channel 44 and an ignition zone 150 of the combustion chamber 12. The pre-mixing disk 40 and/or other portions of the combustor assembly 14 can include various support structure, fasteners, seals, etc. for retaining the pre-mixing disk 40 in place during operation and for allowing for thermal growth to occur.

The annular channel 44 is disposed between the combustor assembly wall 16 and the combustion liner 46. Thus, the supply of air from compressor 11 can cool the combustion liner 46. The combustor assembly 14 can be sealed at one end by an endcover 48. One or more fuel flow passages 42 (only one shown) can extend through the endcover 48. In addition or alternatively, one or more flow conditioners 50 can be disposed upstream from the pre-mixing disk 40. Air supplied from compressor 11 flowing through the annular channel 44 is redirected by the endcover 48 towards the pre-mixing disk 40. The flow conditioner(s) 50 can reduce turbulence, control a pressure drop, and/or provide more uniform air flow to the pre-mixing disk 40. For example, the flow conditioner(s) 50 can be a perforated plate, a collection of tubes, etc.

Figure 3B:
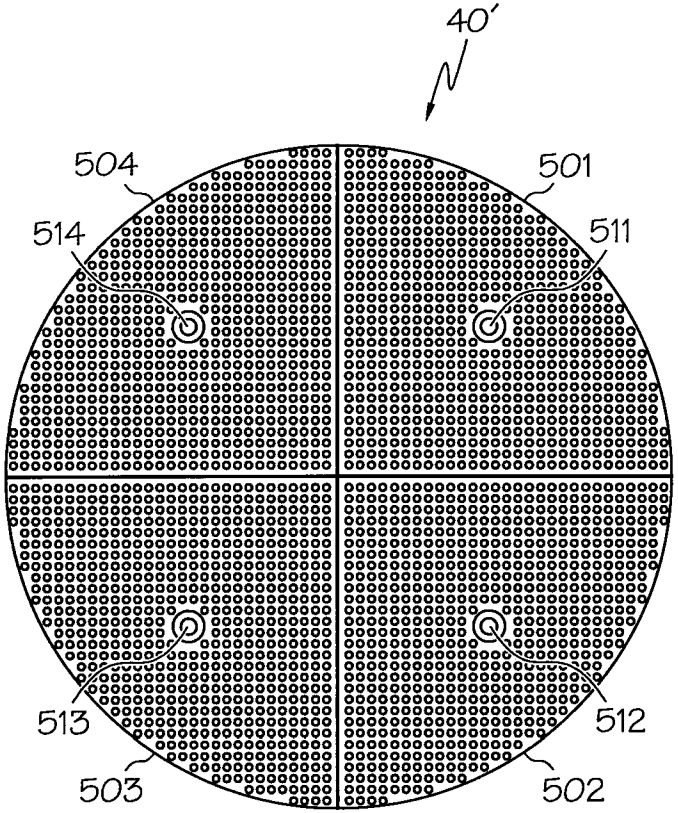
FIG. 3B is similar to FIG. 3A, but shows another example pre-mixing injection disk.
Figure 3A:
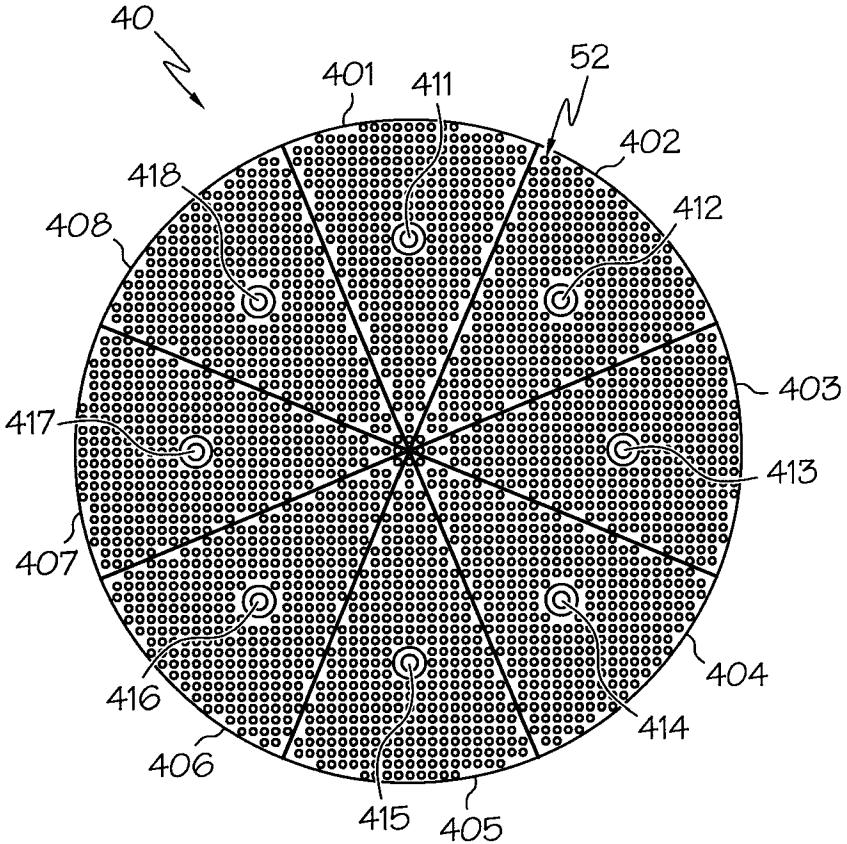
FIG. 3A is an end view of one example pre-mixing injection disk of FIG. 2.
Figure 5:
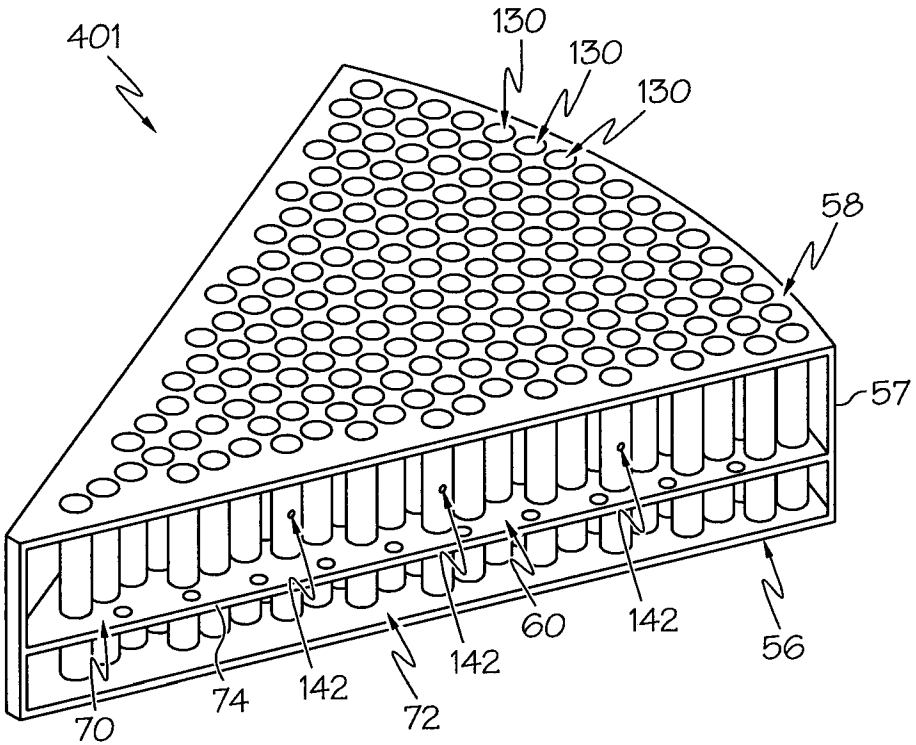
FIG. 5 is one example sector of the pre-mixing injection disk in accordance with the present invention.

Turning briefly to FIG. 3A, one example of the pre-mixing disk 40 includes a first face 56 separated a distance from a second face 58, and coupled thereto via an annular wall 57 (see FIG. 5). The pre-mixing disk 40 further includes a plurality of fuel/air mixing tubes that is shown as a plurality of tubes 52. The plurality of tubes 52 includes individual fuel/air mixing tubes 130 extending through the pre-mixing disk 40 between the first face 56 and the second face 58. The plurality of tubes 52 can be arranged variously about the pre-mixing disk 40 in various patterns, arrays, or even randomly. In one example, the pre-mixing disk 40 can be about 20 inches in outer diameter, though can have various outer diameters in the range of about 10 inches to about 30 inches. Additionally, though illustrated as having a generally circular geometry, the pre-mixing disk 40 can have various other geometries. Similarly, each individual fuel/air mixing tube 130 can have various cross-sectional geometries and/or sizes.

Figure 4:
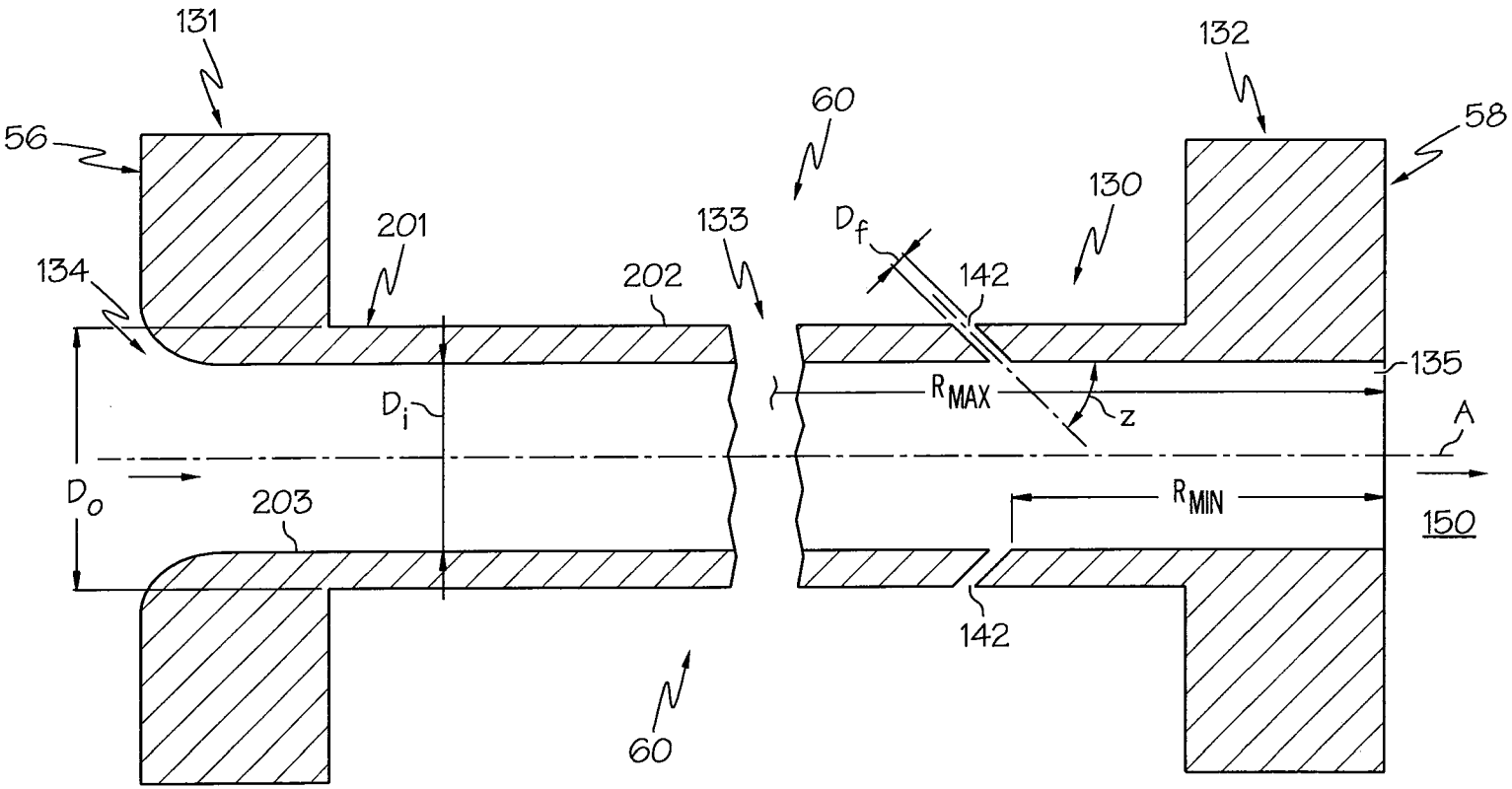
FIG. 4 is a partial cross-section of one example fuel/air mixing tube in accordance with the present invention.

As shown in FIG. 4, each individual fuel/air mixing tube 130 includes a first end section 131 that extends to a second end section 132 through an intermediate portion 133. First end section 131 defines a first fluid inlet 134 at the first face 56, while second end section 132 defines a fluid outlet 135 at the second face 58. Each of the first fluid inlet 134 and/or the fluid outlet 135 can have various features. In one example, the fluid inlet 134 can have a tapered edge geometry, such as a rounded edge, elliptical edge, angled edge, etc., that can reduce a pressure drop of the air flowing therein and/or inhibit the formation of a recirculation zone or the like. In another example, the fluid outlet 135 can have a generally perpendicular edge (i.e., the inner tube wall 203 arranged about 90 degrees relative to the second face 58) to encourage a recirculation zone of the air/fuel mixture so as to stabilize the flame in the ignition zone to create a flamesheet or the like.

For example, with hundreds of air passages (via tubes 130) and even more tiny fuel injection holes 142, fuel/air mixing can occur on scales that are an order of magnitude smaller than on conventional gas-fuel combustion systems. This allows hydrogen operability without flameholding in the premixer, which can destroy the hardware. The rapid fuel-air mixing provides significantly reduced NOx emissions as compared to diffusion-flame combustors. This invention is also designed to partially mitigate the large pressure drop usually associated with small air passages by keeping the individual air passages (via tubes 130) relatively short in length. Lower air-side pressure drop can also provide greater efficiency of the engine.

Referring back to FIG. 2, fuel flow passage 42 is fluidly connected to a fuel plenum 60 of the pre-mixing disk 40 that, in turn, is fluidly connected to a fluid inlet 142 provided in the each of the plurality of individual fuel/air mixing tubes 130. The fuel plenum 60 is a hollow cavity disposed generally between the first face 56 and the second face 58 of the pre-mixing disk 40, and generally surrounds the individual tubes 130. The fuel plenum 60 is coupled to the fuel flow passage 42 via a fuel inlet port (see FIGS. 3A-3C).

With this arrangement, air flows into first fluid inlet 134, of tubes 130, while fuel is passed through fuel flow passage 42, and enters the fuel plenum 60 surrounding individual tubes 130. Fuel flows around the plurality of fuel/air mixing tubes 130 and passes through individual fuel injection inlets (or fuel injection holes) 142 to mix with the air within tubes 130 to form a fuel/air mixture. The fuel/air mixture passes from outlet 135 into an ignition zone 150 and is combusted therein, to form a high temperature, high pressure gas stream that is delivered to turbine 30. The multitude of fuel injection holes 142 allows air/fuel mixing to occur relatively efficiently, which can reduce NOx emissions.

In full load operations for low NOx, the flame should reside in ignition zone 150. However, the use of high hydrogen/syngas fuels has made flashback a problem. In order to avoid any flame holding inside the mixing tubes 130, the heat release inside the mixing tube from a flame inside the tube should be less than the heat loss to the tube wall. This criterion puts constraints on the tube size, fuel jet size and numbers per tube, and fuel jet recession distance. In principal, long recession distance gives better fuel/air mixing. If the mixedness is high, and fuel and air achieve close to 100% mixing, it produces a relatively low NOx output, but is susceptible to flame holding and/or flame flashback within the pre-mixing disk 40 and the individual mixing tubes 130. The individual fuel/air mixing tubes 130 of the plurality of tubes 52 may require replacement due to the damage sustained. Accordingly, as further described, the fuel/air mixing tubes 130 of the present invention create a mixedness that sufficiently allows combustion in an ignition zone 150 while preventing flashback into fuel/air mixing tubes 130. The unique configuration of mixing tubes 130 makes it possible to burn high-hydrogen or syngas fuel with relatively low NOx, without significant risk of flame holding and flame flashback from ignition zone 150 into tubes 130.

Referring now to FIG. 4, one example fuel/air mixing tube 130 from the plurality of tubes 52 is shown. Tube 130 includes an outer tube wall 201 having an outer circumferential surface 202 and an inner circumferential surface 203 extending axially along a tube axis A between a first fluid inlet 134 and a fluid outlet 135. Outer circumferential surface 202 has an outer tube diameter $D_o$ while inner circumferential surface 203 has an inner tube diameter $D_i$. As shown, tube 130 has a plurality of fuel injection holes or inlets 142 disposed circumferentially about the tube, each having a fuel injection hole diameter $D_f$ extending between the outer circumferential surface 202 and inner circumferential surface 203. In a non-limiting embodiment, fuel injection hole diameter $D_f$ is generally equal to or less than 0.05 inches, or even generally equal to or less than 0.03 inches. In another non-limiting embodiment, the inner tube diameter $D_i$ is generally from 2 to 20 times greater than the fuel injection hole diameter $D_f$.

The fuel injection inlets 142 have an injection angle Z relative to tube axis A which, as shown in FIG. 4 is parallel to axis A. As shown in FIG. 4, each of injection inlets 142 has an injection angle Z generally in the range of 20 and 90 degrees. Further refinement of the invention has found an injection angle being generally between 50 and 60 degrees measured with respect to the tube axial direction (i.e., axis A) can be desirable with certain high-hydrogen fuels. Fuel injection inlets 142 are also located a certain distance, known as the recession distance R, upstream of the tube fluid outlet 135. Recession distance R is generally in the range of 5 ($R_{min}$) to 100 ($R_{max}$) times greater than the fuel injection hole diameter $D_f$, while, as described above, fuel injection hole diameter $D_f$ is generally equal to or less than 0.03 inches. The recession distance R can generally depend upon geometric constraints, the reactivity of fuel, and/or the NOx emissions desired. In practice, the recession distance R for hydrogen/syngas fuel is generally equal to or less than 1.5 inches, and the inner tube diameter $D_i$ is generally in the range of 0.05 and 0.3 inches. Further refinement has found recession distance R in the range of 0.3 to 1 inch, while the inner tube diameter $D_i$ is generally in the range of 0.08 and 0.2 inches to achieve the desired mixing and target NOx emission. Some high hydrogen/syngas fuels work better below an inner tube diameter $D_i$ of 0.15 inches. Further refinement of the invention has found an optimal recession distance being generally proportional to the burner tube velocity, the tube wall heat transfer coefficient, the fuel blow-off time, and inversely proportional to the cross flow jet penetration distance, the turbulent burning velocity, and the pressure.

The diameter $D_f$ of fuel injection inlet 142 should be generally equal to or less than 0.03 inches, while each of individual tubes 130 are about 0.8 to 2 inches in length for high reactive fuel, such as hydrogen fuel. Each of the individual tubes 130 can include at least one fuel injection inlet 142, and may have various numbers of fuel injection inlets 142, such as within the range of about 1 to 8 fuel injection inlets 142. For low reactive fuel, such as natural gas, each of the tubes 130 can be as long as one foot in length. Multiple fuel injection inlets 142, i.e. 2 to 8 fuel injection inlets with low pressure drop is also contemplated. With the stated parameters, it has been found that a fuel injection inlet 142 having an angle Z of between 50 and 60 degrees works well to achieve the desired mixing and target NOx emissions. It will be appreciated by one skilled in the art that a number of different combinations of the above can be used to achieve the desired mixing and target NOx emissions. Indeed, all of the individual tubes 130 can be identical, or some or all of the tubes 130 can be different.

For instance, when there are a plurality of fuel injection inlets 142 in a single tube 130, some injection inlets may have differing injection angles Z, as shown in FIG. 4, that e.g. vary as a function of the recession distance R. As another example, the injection angles Z may vary as a function of the diameter $D_f$ of fuel injection inlets 142, or in combination with diameter $D_f$ and recession distance R of fuel injection inlets 142. As yet another example, each of the individual fuel injection inlets 142 can have a differing recession distance R such that various fuel injection inlets 142 are axially offset. As still yet another example, the size of the land between pairs of adjacent fuel injection inlets 142 (i.e., the spacing of the inner circumferential surface 203 between adjacent fuel injection inlets 142) may be equal or may vary. The objective is to obtain adequate mixing while keeping the length of tubes 130 as short as possible and having a low pressure drop (i.e., less than 5%) between fluid inlet end 134 and fluid outlet end 135.

The parameters above can also be varied based upon fuel compositions, fuel temperature, air temperature, pressure and any treatment to inner and outer circumferential walls 202 and 203 of tubes 130. Performance may be enhanced when the inner circumferential surface 203, through which the fuel/air mixture flows, is honed smooth regardless of the material used. It is also possible to protect pre-mixing disk 40, second face 58 which is exposed to ignition zone 150 and the individual tubes 130 by cooling with fuel, air or other coolants. Finally, face 58, adjacent to the normal combustion zone, may be coated with ceramic coatings or other layers of high thermal resistance.

Figure 3C:
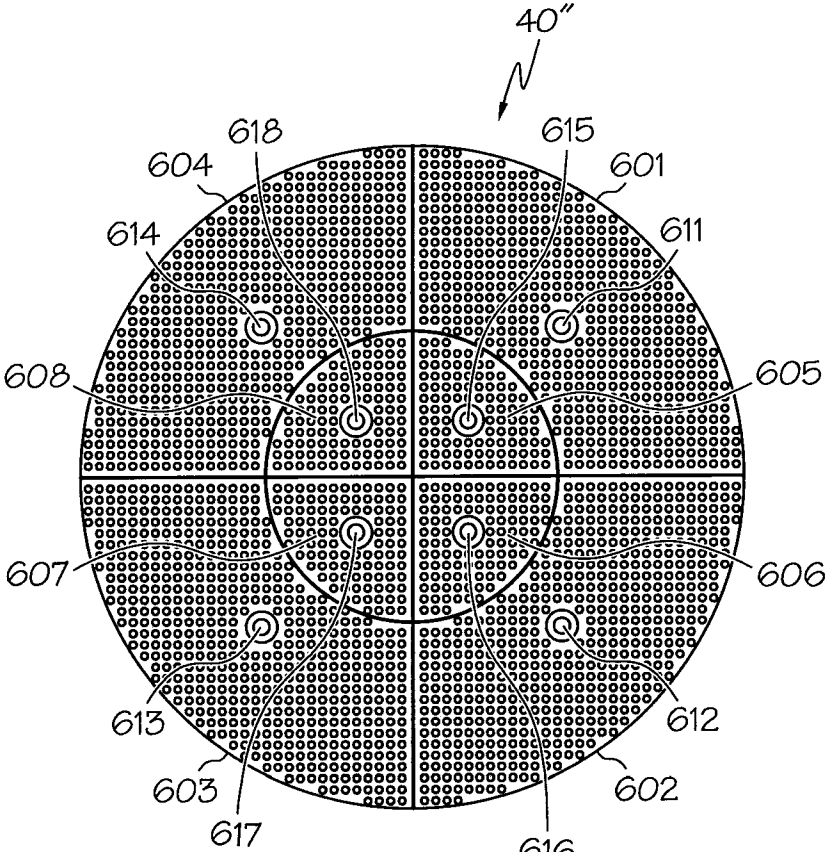
FIG. 3C is similar to FIG. 3A, but shows yet another example pre-mixing injection disk.

Turning now back to FIGS. 3A-3C, the pre-mixing disk 40 can be formed as a monolithic unit, or may be formed of a plurality of sectors that are fastened together. For example, as shown in FIG. 3A, the pre-mixing disk 40 can be formed from a plurality of pie-shaped sectors, such as eight sectors 401-408 having generally equal geometry and size. As shown in FIG. 3B, the pre-mixing disk 40' can be similarly formed of a plurality of four sectors 501-504. As shown in FIG. 3C, the pre-mixing disk 40" can be formed of a plurality of sectors having various sizes and geometries, such as a plurality of annular sectors 601-604 coupled with a plurality of pie-shaped sectors 605-608. Thus, each of the sectors 401-408 or 501-504 can be individually formed, and subsequently fastened together in various removable or non-removable manners, such as mechanical fasteners (e.g., bolts, clips, or the like), adhesives, welding, etc. In any case, various construction techniques can be used, such as a Direct Metal Laser Sintering (DMLS) process.

Keeping with FIGS. 3A-3C, the pre-mixing disk 40, 40', 40" is connected to at least one fuel flow passage 42, and may be connected to a plurality of fuel flow passages each providing an independent supply of fuel. Each fuel flow passage 42 is fluidly connected to one or more fuel plenum(s) 60 of the pre-mixing disk 40 that, in turn, is fluidly connected to the fluid inlet 142 provided in the each of the plurality of individual fuel/air mixing tubes 130. Each fuel plenum(s) 60 can be coupled to the fuel flow passage(s) 42 via a fuel inlet port. As shown in FIGS. 3A-3B, each sector 401-408 and 501-504 can include an individual fuel inlet port 411-418 and 511-514, respectively. Thus, variation of the fuel supply to each of the individual fuel inlet ports 411-418 and 511-514 can provide for different fuel compositions or fuel/air ratio at different sections of the premixer. Multiple, separately-fueled zones can control combustion dynamics and lean blowout and allow staging, which can permit for increased fine-tuning ability to achieve relatively increased engine efficiency, lower emissions, and/or reduced combustion dynamics that could damage the equipment. For example, it can be determined to alter the fuel supply to sector 401 via the fuel inlet 411 without altering the fuel supply to any of the other sectors.

It is noted that if the premixer disk is of a monolithic construction, individual zones or sectors, such as those as shown in FIGS. 3A, 3B, and 3C, may be created by including divider walls inside the disk to form a plurality of fuel plenums 60. Each fuel plenum 60 can be coupled to a fuel flow passage 42 via a fuel inlet port.

As noted before, each of the sectors 401-408, 501-504, and 601-608 can be in fluid communication with each other, or some or all sectors can be fluidly separated from other sectors. Thus, each pre-mixing disk 40, 40', 40" can have a plurality of fuel plenums 60. For example, the fuel inlet 611 can supply fuel to at least both of sectors 601 and 605, which can share a common fuel plenum. Thus, altering the fuel supply to sectors 602 and 606 via the fuel inlet 612 can be performed without altering the fuel supply to any of the other sectors. Alternatively, each sector 601-608 can be supplied by a dedicated fuel inlet 611-618, respectively.

Turning now to FIG. 5, one of the plurality of pie-shaped sectors 401 will now be discussed, though it is to be understood that such discussion similarly applies to a various constructions of the pre-mixing disk 40, such as a monolithic construction. As shown and discussed herein, the example sector 401 includes a plurality of individual fuel/air mixing tubes 130 extending therethrough between the first face 56 and the second face 58. The fuel plenum 60 is a hollow cavity disposed generally between the first face 56 and the second face 58 and generally surrounding the individual tubes 130. The fuel plenum 60 can be one continuous cavity, or as shown, can be separated in a plurality of cavities 70, 72 separated by one or more flow conditioner(s) 74. The flow conditioner(s) 74 can reduce turbulence, control a pressure drop, and/or provide more uniform fuel flow within the fuel plenum 60. The flow conditioner(s) 74 can be a perforated plate. In one example, the fuel can flow into the cavity 70, pass through the conditioner 74 and into the cavity 72 before entering the fuel injection holes 142 for mixing with the air in the tubes 130. In another example, the fuel can flow first into the cavity 72, pass through the conditioner 74 into the cavity 70, and be redirected back into the cavity 72 before entering the fuel injection holes 142. Thus, the fuel flow can also be used to cool the faces 56, 58 and/or the tubes 130 to protect the features from thermal damage and reduce the tendency for flame holding inside the tubes 130.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel/air mixing disk for use in a fuel/air mixing combustor assembly comprising:

a plurality of adjacent, pie-shaped sectors, each sector having a first face, a second face, and an annular wall coupling the first and second faces together and separating the first and second faces to provide at least one fuel plenum disposed between the first and second faces and bounded by the annular wall and adapted to be in fluid communication with a fuel flow passage extending from an end cover of the combustor assembly transverse to the first face and intersecting the first face at a central position of at least one sector of the disk away from the annular wall; and a plurality of fuel/air mixing tubes extending through each sector between the first face and the second face, each mixing tube including an outer tube wall extending axially along a tube axis between an inlet end and an exit end and in fluid communication with the at least one fuel plenum, each mixing tube being attached at its respective inlet end to the first face and at its respective outlet end to the second face, at least a portion of the plurality of fuel/air mixing tubes further including at least one fuel injection hole having a fuel injection hole diameter extending through said outer tube wall, said at least one fuel injection hole having an injection angle relative to said tube axis, said injection angle being in the range of 20 to 90 degrees, and wherein a recession distance between said fuel injection hole and said exit end along said tube axis is about 5 to 100 times greater than said fuel injection hole diameter.

2. The fuel/air mixing disk of claim 1, wherein said recession distance is equal to or less than 1.5 inches and said tube diameter is in the range of 0.05 and 0.3 inches.

3. The fuel/air mixing disk of claim 1, wherein the recession distance is in the range of 0.3 to 1 inches and said tube diameter is in the range of 0.05 and 0.3 inches.

4. The fuel/air mixing disk of claim 3, wherein the fuel injection hole diameter of said at least one fuel injection hole is equal to or less than 0.03 inches.

5. The fuel/air mixing disk of claim 1, wherein said injection angle is about 50 to 60 degrees measured with respect to the tube axial direction.

6. The fuel/air mixing disk of claim 1, comprising a plurality of fuel injection holes having a plurality of fuel injection hole diameters.

7. The fuel/air mixing disk of claim 1, comprising a plurality of fuel injection holes having a plurality of fuel injection hole angles.

8. The fuel/air mixing disk of claim 7, wherein said plurality of fuel injection holes comprises about 2 to 8 fuel injection holes.

9. The fuel/air mixing disk of claim 1, wherein the inlet end of at least a portion of the fuel/air mixing tubes includes a tapered geometry.

10. The fuel/air mixing disk of claim 1, wherein each sector has an individual fuel inlet port.

11. The fuel/air mixing disk of claim 1, wherein the at least one fuel plenum includes a plurality of cavities separated by a flow conditioner.

12. A fuel/air mixing disk for use in a fuel/air premixing combustor assembly comprising:

a plurality of adjacent, pie-shaped sectors, each sector having a first face, a second face, and an annular wall coupling the first and second faces together and separating the first and second faces to provide at least one fuel plenum disposed between the first and second faces and bounded by the annular wall and adapted to be in fluid communication with a fuel flow passage extending from an end cover of the combustor assembly transverse to the first face and intersecting the first face at a central position of at least one sector of the disk away from the annular wall; and a plurality of fuel/air mixing tubes extending through each sector between the first face and the second face, each mixing tube including an outer tube wall extending axially along a tube axis between an inlet end and an exit end and in fluid communication with the at least one fuel plenum, and an inner tube surface having an inner diameter, each of the plurality of fuel/air mixing tubes further including at least one fuel injection hole having a fuel injection hole diameter extending through said outer tube wall, said at least one fuel injection hole having an injection angle relative to said tube axis, said inner diameter of said inner tube surface being from 2 to 20 times greater than said fuel injection hole diameter, and wherein a recession distance between said fuel injection hole and said exit end along said tube axis is about 1 to 100 times greater than said fuel injection hole diameter.

13. The fuel/air mixing disk of claim 12, wherein said injection angle being in the range of 20 and 90 degrees.

14. The fuel/air mixing disk of claim 12, wherein said fuel injection hole diameter is about equal to or less than 0.03 inches.

15. The fuel/air mixing disk of claim 12, further comprising a recession distance extending between said fuel injection hole and said exit end along said tube axis, said recession distance being between 5 to 100 times greater than said fuel injection hole diameter.

16. The fuel/air mixing disk of claim 15, wherein said inner diameter of said inner tube surface is less than 0.2 inches.

17. The fuel/air mixing disk of claim 12, wherein each sector has an individual fuel inlet port.

18. A method of mixing high-hydrogen or synthetic gas fuel in a premixed direct injection disk for a turbine combustor, said method comprising;

providing a plurality of adjacent, pie-shaped sectors, each sector having a first face, a second face, and an annular wall coupling the first and second faces together and separating the first and second faces to provide at least one fuel plenum disposed between the first and second faces and bounded by the annular wall and adapted to be in fluid communication with a fuel flow passage extending from an end cover of the combustor assembly transverse to the first face and intersecting the first face at a central position of at least one sector of the disk away from the annular wall;

wherein each sector further comprises fuel/air mixing tubes extending between the first face and the second face, each of said plurality of mixing tubes extending axially along a flow path between an inlet end and an exit end and having at least one injection hole in fluid communication with the at least one fuel plenum, said at least one injection hole being oriented at an angle in the range of 20 to 90 degrees relative to a tube axis, each of said plurality of tubes including an outer tube wall extending axially along a tube axis between said inlet end and said exit end;

injecting a first fluid into said plurality of mixing tubes at said inlet end;

providing a gaseous high-hydrogen fuel or a gaseous synthetic fuel into said at least one fuel plenum;

injecting the high-hydrogen fuel or synthetic fuel from the at least one fuel plenum into said mixing tubes through the plurality of injection holes; and mixing said first fluid and said high hydrogen fuel or synthetic fuel to a mixedness of greater than 50% fuel and first fluid mixture at said exit end of said tubes.

19. The method of claim 18, wherein said mixedness occurs at a location between 0.6 and 0.8 inches downstream of said fuel injection holes.

20. The method of claim 18, wherein each tube comprises within the range of about 1 to 8 fuel injection holes.

* * * * *